US006670936B1

(12) United States Patent
Akimoto et al.

(10) Patent No.: US 6,670,936 B1
(45) Date of Patent: Dec. 30, 2003

(54) LIQUID CRYSTAL DISPLAY

(75) Inventors: Hajime Akimoto, Ome (JP); Mutsuko Hatano, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/582,936

(22) PCT Filed: Jan. 9, 1998

(86) PCT No.: PCT/JP98/00056

§ 371 (c)(1),
(2), (4) Date: Jul. 7, 2000

(87) PCT Pub. No.: WO99/35521

PCT Pub. Date: Jul. 15, 1999

(51) Int. Cl.[7] ..... G09G 3/36

(52) U.S. Cl. ..... 345/92; 345/87; 345/89; 345/90; 345/97

(58) Field of Search ..... 345/58, 89, 90, 345/92, 206, 211, 87, 97–101; 349/39, 43, 75, 88, 155; 323/280

(56) References Cited

U.S. PATENT DOCUMENTS

| | | | | | |
|---|---|---|---|---|---|
| 4,204,219 | A | * | 5/1980 | Uchida | 348/533 |
| 4,873,516 | A | * | 10/1989 | Castleberry | 340/784 |
| 5,489,910 | A | * | 2/1996 | Kuwata et al. | 345/212 |
| 5,581,274 | A | * | 12/1996 | Tagawa | 345/104 |
| 5,589,847 | A | * | 12/1996 | Lewis | 345/98 |
| 5,706,022 | A | * | 1/1998 | Hato | 345/92 |
| 5,717,457 | A | * | 2/1998 | Morimoto | 348/241 |
| 5,739,803 | A | * | 4/1998 | Neugebauer | 345/98 |
| 5,774,099 | A | * | 6/1998 | Iwasaki et al. | 345/87 |
| 5,953,060 | A | * | 9/1999 | Dierickx | 348/241 |
| 6,118,438 | A | * | 9/2000 | Ho | 345/204 |
| 6,141,078 | A | * | 10/2000 | Morii et al. | 349/155 |
| 6,229,510 | B1 | * | 5/2001 | Kim et al. | 345/87 |
| 6,292,237 | B1 | * | 9/2001 | Hebiguchi | 349/39 |
| 6,300,927 | B1 | * | 10/2001 | Kubota et al. | 345/92 |
| 6,304,308 | B1 | * | 10/2001 | Saito et al. | 349/155 |
| 6,323,851 | B1 | * | 11/2001 | Nakanishi | 345/211 |
| 6,331,844 | B1 | * | 12/2001 | Okumura et al. | 345/87 |
| 6,359,607 | B1 | * | 3/2002 | Yanagi et al. | 345/94 |
| 6,366,065 | B1 | * | 4/2002 | Morita | 323/280 |
| 6,392,626 | B1 | * | 5/2002 | Moon | 345/94 |
| 6,469,740 | B1 | * | 10/2002 | Kuroda et al. | 348/308 |

FOREIGN PATENT DOCUMENTS

| | | | |
|---|---|---|---|
| JP | 7-159807 | | 6/1994 |
| JP | 06-266318 | * | 9/1994 |
| JP | 6-266318 | | 9/1994 |
| JP | 7-92504 | | 4/1995 |
| JP | 10-301539 | * | 11/1998 |
| WO | WO 98/40873 | * | 9/1998 |

OTHER PUBLICATIONS

SID 96 Digest, pp. 21–24.

* cited by examiner

*Primary Examiner*—Vijay Shankar
*Assistant Examiner*—Prabodh M. Dharia
(74) *Attorney, Agent, or Firm*—Mattingly, Stanger & Malur, P.C.

(57) ABSTRACT

An object is to eliminate fixed pattern noise due to unevenness or variation of the threshold voltages in DA converters and buffer circuits, when forming a pixel portion integrated with a peripheral driver circuit, including the DA converters, by using polycrystalline Si TFT.

For that purpose, a pixel common electrodes is provided independently for each of a signal line, and an output of the buffer circuit is connected to both the common electrode and the signal electrode through a switch.

With this, the variation of the threshold voltages in the buffer circuits are cancelled between the common electrode and the signal electrode, thereby enabling to remove the above-mentioned fixed pattern noise therefrom.

15 Claims, 6 Drawing Sheets

LIQUID CRYSTAL DISPLAY

TECHNICAL FIELD

The present invention relates to a liquid crystal image display for displaying video with driving liquid crystal, in particular, relates to a technology being suitable to be applied to a low price and high performance liquid crystal image display using a thin film transistor (TFT) therein.

BACKGROUND ART

The structure of a video display device of the conventional art is shown in FIG. 7.

In a matrix-like manner are disposed pixels, each being constructed with a TFT switch 101 and a pixel capacitor 102 which has a pixel electrode connected to a source electrode thereof as well as a common electrode. A liquid crystal is provided in the pixel capacitor 102 at a predetermined position thereof, and it is changed or modulated in the optical characteristic thereof by write-in voltage to the pixel capacitor 102, thereby enable to display the video thereon. To the gate of the TFT switch 101 is connected a gate line 103, and at one end of which is provided a vertical shift register 105. Also, the drain of the TFT switch 101 is connected a signal line 104, and at one end of which is provided a DA converter 106. On a while, the signal line 109 is inputted through a signal latch 107 to the DA converter 106. To the signal latch 107 is inputted a signal of a horizontal shift register 110. The common electrodes of all the pixels are connected into one body to which a constant voltage is applied.

Further, herein the each portion, such as the DA converter 106, etc., shown in FIG. 6 is constructed by using Poly-Si (polycrystalline silicon) TFT.

Hereinafter, operation of the present conventional art will be explained. A digital input signal inputted to the signal line 109 is latched in the signal latch 107, sequentially, in accordance with scanning of the horizontal shift register 110. The input signals being latched are inputted, collectively, to the DA converter 106 so as to be converted into analogue signals to be applied to the signal lines 104. At this moment, in the pixels on a line whose gate line 103 is selected by this vertical shift register 105, since the TFT switch 101 thereof is in ON state, the analogue signal which is applied to the signal line 104 is written into the pixel capacitor 102. As a result of this, an electric field corresponding to the input signal is applied to the liquid crystal portion of the pixels, into which the signals are written, therefore it is possible to display the video depending upon the signals.

An example of such the conventional video display device is described in detail, for example in "Society for Information Display International Symposium Digest of Technical Papers 96 (SID 96), pp.21–24", etc.

Also, in Japanese Patent Laying-Open No. Hei 6-266318 (1994) is disclosed a technology, that the common electrodes are provided with being divided for each of the signal lines, and a signal voltage and a voltage having a reversed polarity thereof are applied in synchronism with a signal which is supplied to the signal line, thereby suppressing the voltage between anodes of field effect transistors within the pixels.

In the former of the above-mentioned conventional arts, since the DA converter 106 is not connected to the signal line 104 directly, there is a problem that an output of the DA converter 106 is modulated by a load carrying capacitor of the signal line 104 if an output impedance of the DA converter 106 is not designed to be small sufficiently. While trying to design the output impedance of the DA converter 106 to be sufficient small, an area of the DA converter 106 comes to be large, excessively.

For preventing such things, in a driver circuit using mono-crystalline Si (silicon) transistors, generally, a buffer circuit is provided between the output of the DA converter 106 and the signal line 104. However, in a case where the pixel portion is formed with the driver circuit including peripheral circuits thereof in one body, by using Poly-Si (polycrystalline silicon) TFT, it is very difficult to provide the buffer circuit. This is because the Poly-Si TFT, differently from Si (silicon) transistor, inherently has very large unevenness or variation in the threshold voltage thereof, when the buffer circuit is provided for each of the lines, a large fixed pattern noise is caused on the display video due to the unevenness or variation of the threshold voltage for each line.

Also, in the above-mentioned Japanese Patent Laying-Open No. Hei 6-266318 (1994), there is disclosed that the common electrode is provided separately for each signal line and a signal voltage and a voltage of reversed polarity are applied to the common electrode in synchronism with the signal supplied to the signal line, however there is not disclosed the structure of removing the fixed pattern noise due to the unevenness or variation the threshold voltages of elements which construct a signal voltage applying portion, such as the buffer circuit, etc., at all.

An object, according to the present invention, is to provide a liquid crystal image display for high quality video, with removing the fixed pattern noise due to the unevenness or variation in the threshold voltage of the elements which construct the signal voltage applying portion, such as the buffer circuit, etc.

The object mentioned above and other objects, as well as the novel features, according to the present invention, will be apparent from the description and the attached drawings of the specification.

DISCLOSURE OF THE INVENTION

Explaining an outline of the representative example of the present invention being disclosed herewith, briefly, it is as follows.

Namely, according to the present invention, for achieving the above-mentioned object, the common electrodes are provided independently for each signal line, and an output of a signal voltage applying portion, such as the buffer circuit, etc., is connectable to both the corresponding common electrode and the signal line, selectively, thereby enabling to apply voltage to both the signal line and the common line by means of the signal voltage applying portion, such as the buffer circuit, etc. The variation of the threshold voltages in the signal voltage applying portions, such as the buffer circuits, etc., each of which is provided for each of lines, appears to be the variation of offset voltages at outputs of signal applying portions, however with application of such the construction mentioned above, according to the present invention, the offset voltage is supplied to the both of the corresponding signal line and the common electrode, equally, within one of the lines, therefore no variation of the threshold voltages can be observed between the lines among the pixel electrodes which drive the liquid crystal and the common electrodes. Accordingly, the large fixed pattern noises, being caused due to the variation of the threshold voltages among elements of the signal voltage applying portion for each line, will not occur on the display video, thereby providing a liquid crystal image display having a high quality.

BEST MODE FOR CARRYING OUT THE INVENTION

Hereinafter, a first embodiment according to the present invention will be explained by referring to the attached drawings FIGS. 1 to 4.

Figure 1:
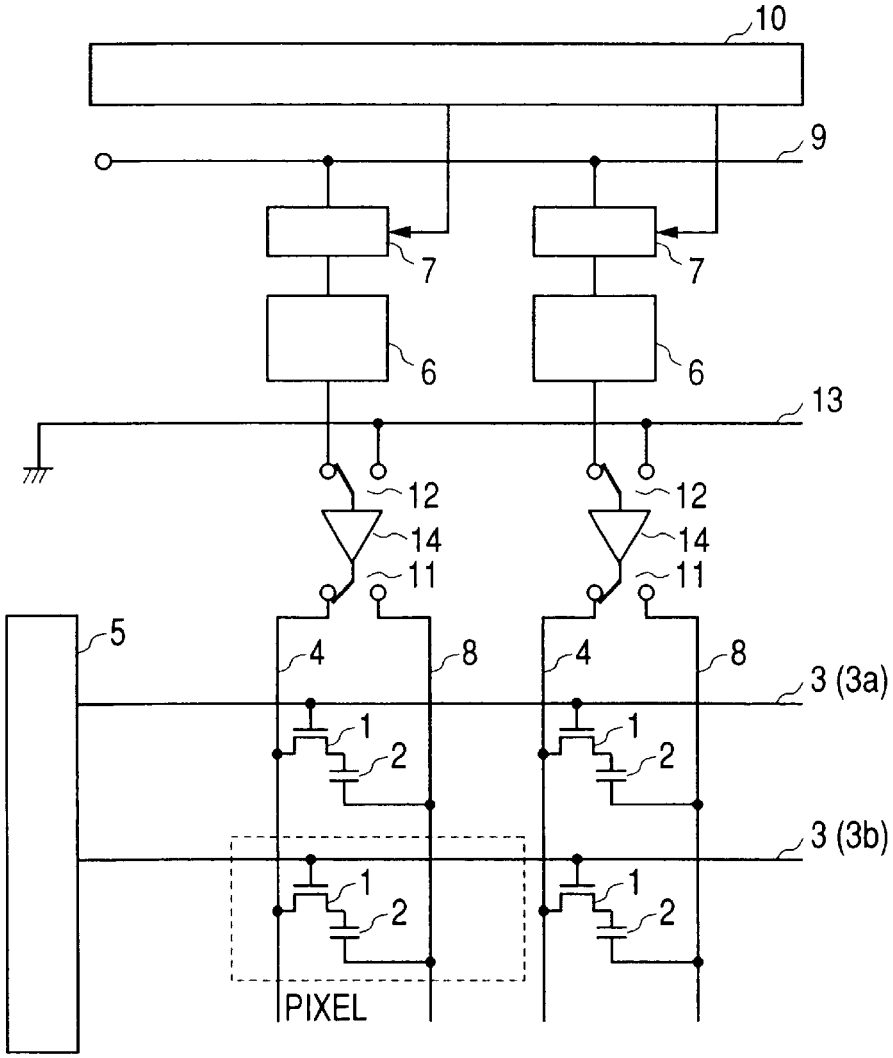
FIG. 1 is a structual view of an embodiment of a liquid crystal image display according to the present invention.

FIG. 1 shows the structural of a first embodiment of a video display device, according to the present invention. Pixels, each being constructed with a TFT (Thin Film Transistor) switch 1 and a pixel capacitor 2 having a pixel electrode connected to a source electrode thereof and a common electrode, are disposed in a matrix-like manner. In the pixel capacitor 2 is provided a liquid crystal at a predetermined position, and an optical property of which is changed or modulated by write-in voltage into the pixel capacitor 2, thereby enabling to display the video or image thereon. To the gate of the TFT switch 1 is connected a gate line 3, and at one end of the gate line 3 is provided a vertical shift register 5. Also, to the drain of the TFT switch 1 is connected a signal line 4, and at one end of the signal line 4 is provided an exchange switch 11. A common electrode 8 is provided for each of lines, independently, forming a pair together with the signal line 4, and the end of the common electrode 8 is also connected to the exchange switch 11. At the other end of the exchanger switch 11 is provided a unity gain amplifier 14, to an input of which is connected to the input exchange switch 12. Herein, the reason of using the unity gain amplifier is for the purpose of suppressing the variation or fluctuation of the gains of the amplifiers. However, it does not matter to use the amplifiers, each of which has an arbitrary gain, if it is possible to bring the gains of the amplifiers to a constant value by using large ratio of capacitors, etc. At the other ends of the input exchange switch 12 are provided a DA converter at one of them, and a reference voltage line 13 at the other thereof. On a while, a signal input line 9 is inputted through a signal latch 7 to a DA converter 6. To the signal latch 7 is inputted a signal of a horizontal sift register 10.

However, herein each the portion, such as the DA converter 6 and the unity gain buffer 14, etc., which are shown in the FIG. 1, is constructed with the Poly-Si (polycrystalline silicon) TFTs. In this manner, with using the Poly-Si TFT circuits, it is possible to reduce such cost for mounting as in using a LSI of single crystal.

Also, although here is not shown the details of the horizontal shift register 10, the vertical shift register 5, the latch 7 and the DA converter 6, there can be applied the conventional circuits which are already known, for example, such the circuits as were described in the above-mentioned "Society for Information Display International Symposium Digest of Technical Papers 96 (SID 96), pp. 21–24", etc.

Hereinafter, operation of the present embodiment will be explained.

Digital input signals which are inputted to the signal input line 9 are latched into the signal latch 7, sequentially, in accordance with scanning of the horizontal shift register 10. The input signals which are latched are inputted into the DA converter 6 at once, collectively, thereby to be converted into analogue signals.

The operations of the input exchange switch 12, as the input to the unity gain buffer 14, and of the exchange switch 11, as the output, in this instance, will be explained below, by referring to the FIG. 2.

Figure 2:
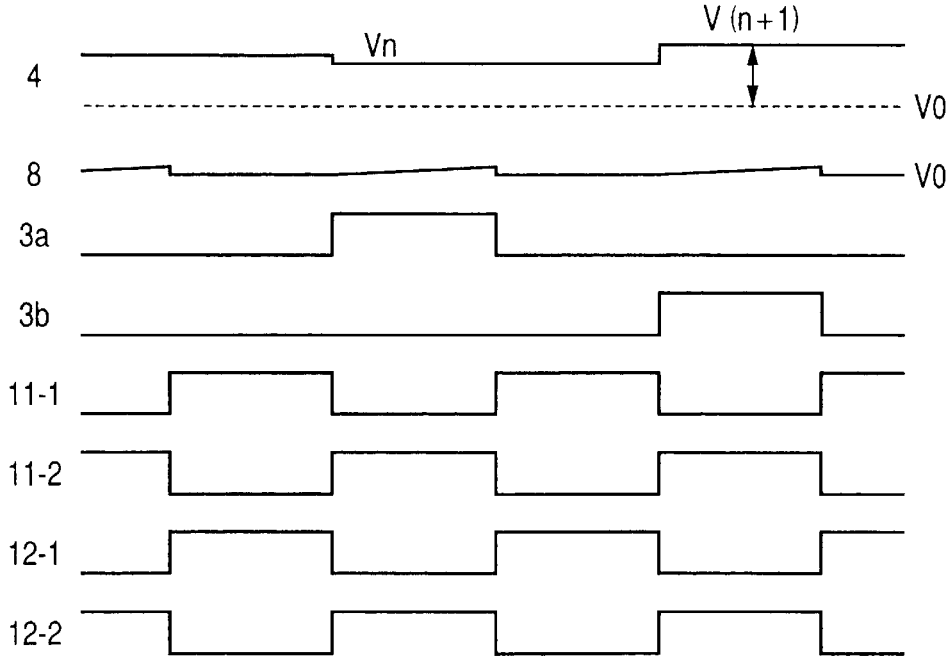
FIG. 2 is a view for explaining the operation of an exchange switch, an input exchange switch, a signal line, a common electrode, and a gate line.

FIG. 2 is the view for explaining the operations of the exchange switch 11, the input exchange switch 12, the signal line 4, the common electrode 8 and the gate line 3. Herein, in particular, the exchange switch 11, the input exchange switch 12, the signal line 4 and the gate line 3 are indicated to be in ON conditions when the signals are high, otherwise in OFF conditions when they are low. Also, a reference numeral 11-1 indicates the exchange switch 11 at the side of the common electrode 8, while 11-2 that at the side of the signal line 4, and 12-1 the input exchange switch 12 at the side of the reference voltage line 13 while 12-2 that of the side of the DA converter 6.

First, when the input exchange switch 12-1 is turned On while 12-2 OFF, a reference voltage is inputted to the input of the unity gain buffer 14 from the reference voltage line 13. This reference voltage is, for example, at the ground potential. In this instance, the exchange switch 11-1 is turned ON while 11-2 OFF at the same time, therefore the output of the unity gain buffer 14 is outputted to the common electrode 8. In this manner, to the common electrode 8 is applied an output V0 of the unity gain buffer 14 with respect to the reference voltage input. Namely, the common electrode 8 is reset from the value of voltage shifted due to leak current, etc., back to V0. In this instance, it is preferable that the capacity of the common electrode is large, and an additional capacitor may be added, separately. Continuously, when the input exchange switch 12-1 is turned OFF while 12-2 ON, an analogue signal voltage is inputted to the input of the unity gain buffer 14 from the DA converter 6. In this instance, the exchange switch 11-1 is turned OFF while 11-2 ON at the same time, therefore the output of the unity gain buffer 14 is outputted onto the signal line 4. In this manner, onto the signal line 4 is applied an output Vn (n: the number of the gate line) of the unity gain buffer 14 is applied. Herein, the unity gain buffer 14 is constructed with using the Poly-Si TFT, therefore to the output thereof is added with the offset voltage V0 due to the unevenness or variation of the threshold voltage, however since this offset voltage V0 is added not only to the signal line 4 but also to the common electrode 8, the offset voltage V0 is cancelled between the common electrode 8 and the signal line 4. Here, a predetermined gate line 3-a is selected by the vertical shift register 5, so that the signal voltages are written through the TFT switches into the pixel electrodes 2 of the line corresponding to this gate line, however the unevenness or variation in the offset of the unity gain buffer 14 does not occur in the signal voltages (Vn–V0) which are applied to the pixel electrodes. As a result of this, it is possible to display the video corresponding to the input signals, but without inputting of the fixed pattern noise caused due to the unevenness or variation in the threshold values of the TFT in the liquid crystal portion of the pixels into which the signals are written.

Namely, in the present embodiment, the fixed pattern noise is removed, by dividing the common electrodes electrically for each line of the pixels, and by supplying the offset voltages, being different for the each line of pixels, also to the common electrodes which are electrically divided for the each line of the pixels.

Here, the periods for the input exchange switch 12 and the exchange switch 11 OFF to be turned ON and OFF can be ensured or maintained with a large operation margin, by making them a half of the period (a horizontal scanning period), in which the signal is inputted into the pixels of one (1) line, each, for example.

Also, the input exchange switch 12 and the exchange switch 11 are constructed with CMOS switches using the TFT.

Next, explanation will be given on the circuit construction of the unity gain buffer 14, by referring to FIG. 3.

Figure 3:
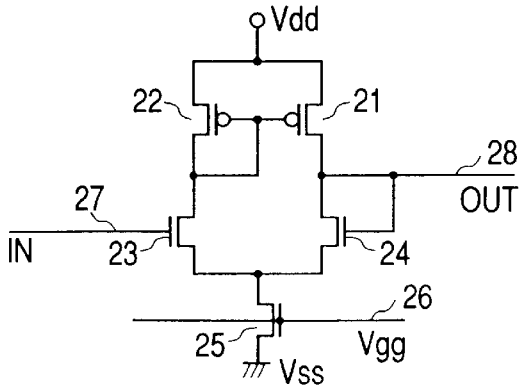
FIG. 3 is a view for showing an example of the circuit structure of a unity gain buffer.

The FIG. 3 shows the circuit construction of the unity gain buffer 14. The unity gain buffer 14 is composed from a differential amplifier using the Poly-Si TFT. The input signal is inputted from the input portion 27 to a gate of a nMOS TFT 23 which takes the pMOS TFT 22 as the load thereof, while the output is outputted from an output portion 28 to be negatively fed back to the gate of the nMOS TFT 24 which takes the nMOS TFT 21 as the load thereof. However, the nMOS TFT 25 operates as a constant current source to be controlled by a bias line 26. In this manner, the unity gain buffer 14 is constructed by forming the negative feedback onto the high gain differential amplifier.

Next, explanation will be given on the pixel structure by referring to FIGS. 4A and 4B.

Figure 4A:
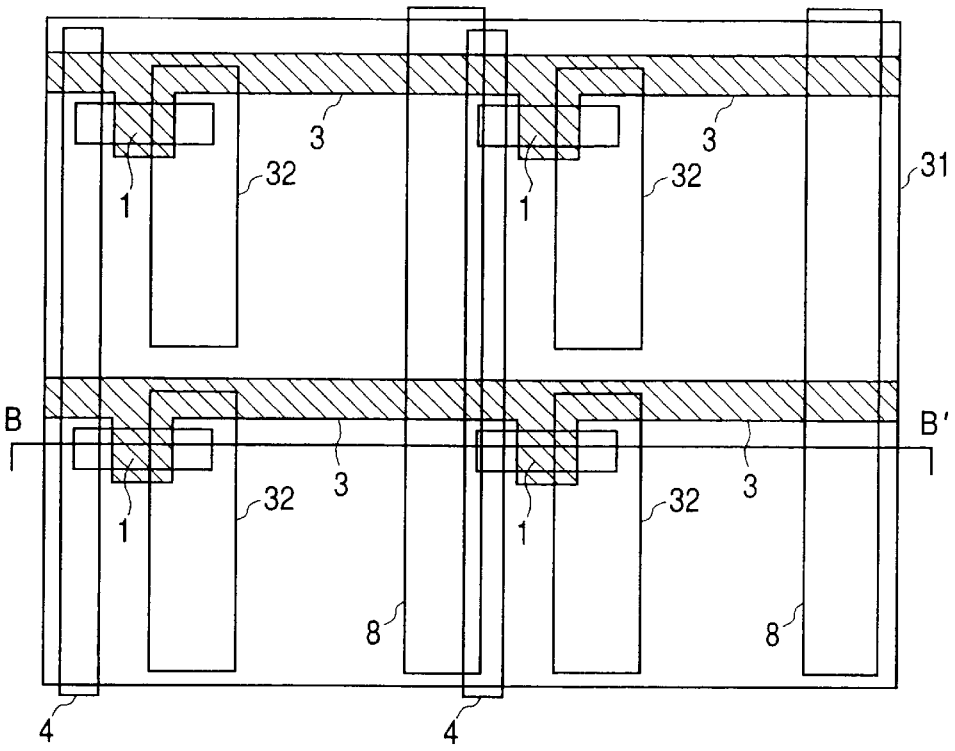
FIGS. 4A and 4B are a view for showing a level structure of pixels of an example of the liquid crystal image display according to the present invention, and a view for showing the structure in cross-section thereof, respectively.
Figure 4B:
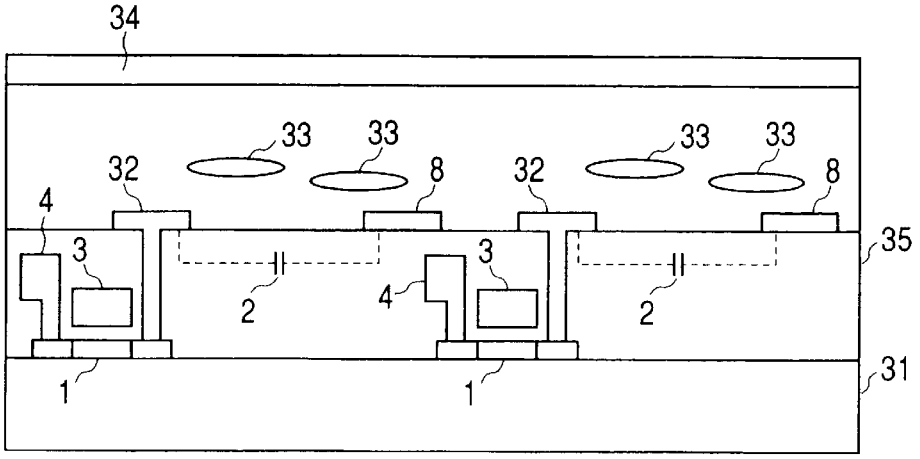

The FIG. 4A is a plane view of the structure of the pixels, and the FIG. 4B is a view of showing the cross-section structure at the position B–B' indicated in the FIG. 4A. Herein are shown only the pixels of 2×2 for simplification of explanation. Upon a glass substrate 31 are provided TFT switches 1, each having the gate constructed with the gate line 3, and the drain of the TFT switch 1 is connected to the signal line 4. Further, the source of the TFT switch 1 constructs the pixel capacitor 2 through the source electrode 32 between the common electrode 8. In the FIG. 4A, the contact between the signal line 4 and the above-mentioned drain and the contact between the source electrode 32 and the above-mentioned source are omitted for the purpose of simplification of the drawing.

Here, the signal line 4 and the common electrode 8 are disposed in parallel, and are perpendicular to the gate line 3.

Though the source electrode 32 forms the pixel capacitor 2 between the common electrode 8, liquid crystal molecular 33 are disposed in the pixel capacitor 2 and the molecular is rotated in the horizontal direction by the voltage applied across the pixel capacitor 2, thereby being changed or modulated in the optical characteristic thereof. On the upper surface is provided a glass plate 34 on which a polarization film is mounted. A reference numeral 35 indicates an insulator film.

Switching mode of the liquid crystal in a horizontal plane thereof is called, in general, by IPS (In-Plane Switching), and by using this IPS method or mode, it is possible to construct the common electrode 8 on the glass substrate 31, on which the source electrodes 32, the TFTs and the switches 11 are mounted, therefore there is no necessity of connecting the output of the exchange switch 11 to the side of the glass plate 34, so as to make the manufacturing processes thereof easier.

Also, though not necessary to say, it is possible to apply the present invention to the conventional liquid crystal image display which adopts the vertical electric field liquid crystal mode therein. However, in that case, the common electrode 8 must be constructed on the glass plate 34, differently from such the source electrodes 34, TFTs or the exchange switches 11, then there is a necessity of connecting the output of the exchange switch 11 to the glass plate 34. Namely, between the glass substrate 31 and the glass plate 34, there is a necessity of connecting wires of the number being same to that of the lines of the pixels.

Though not mentioned in the embodiment mentioned above especially, with the structure in which the common electrode 8 and the source electrodes 32 are constructed with using conductive transparent film, such as ITO (indium tin oxide), etc., it is needless to say, but the increase of fill factor can be obtained therefrom.

In the above-mentioned embodiment, there is no specific restriction with respect to the structure of the DA converter 6. The DA converter 6 may be constructed with a method of adding voltages by using the capacitors, as was in the conventional art mentioned above, and it also maybe constructed with the structure having good uniformity in gradation, by using a method of dividing voltage with resistors or a variation thereof, as was in the driver circuits using general Si transistors therein.

Hereinafter, explanation will be given on a second embodiment according to the present invention, by referring to FIG. 5.

Since the basic structure and operation are same to those of the above-mentioned first embodiment, the explanation thereon will be omitted here. Here, only the characteristic structure and effect thereof will be explained below.

Figure 5:
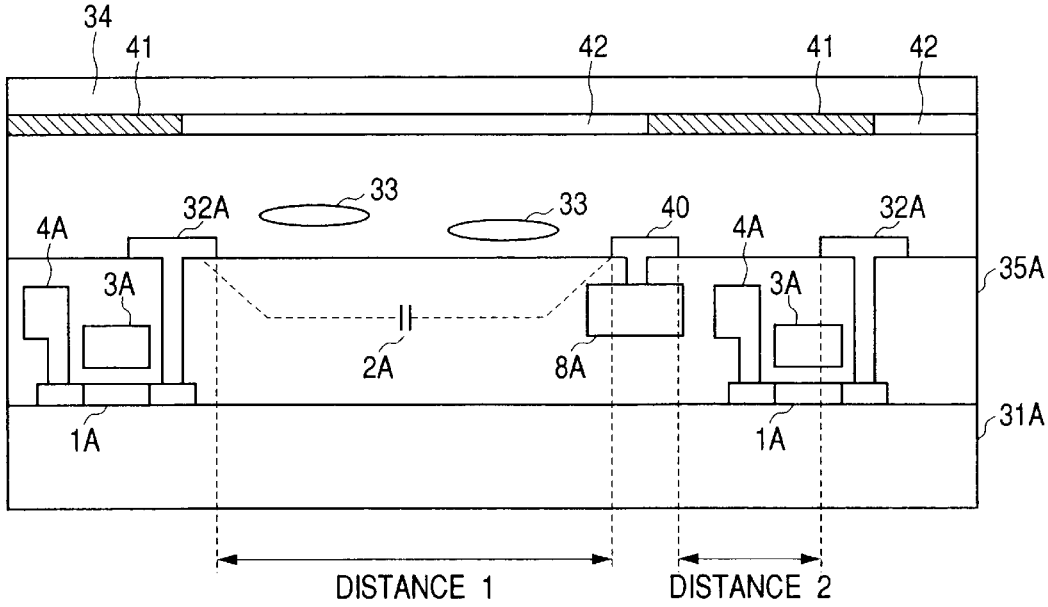
FIG. 5 is a view for showing the structure of a second embodiment of the liquid crystal image display, according to the present invention, in cross-section thereof.

The FIG. 5 is a view of showing the cross-section structure of the pixels, according to the second embodiment of the present invention. Each reference numeral in the FIG. 5 is indicated with addition of a mark or suffix "A" to the same reference numeral corresponding to that in the FIG. 4B. The gate of the TFT switch 1A is constructed with the gate line 3A, while the drain thereof is connected to the signal line 4A. The source electrode 32A constructs the pixel capacitor 2A between the common electrode 40. Between the electrodes of the pixel capacitor 2A are disposed the liquid crystal molecular 33, and the molecular is rotated in the horizontal direction by the voltage applied across the pixel capacitor 2A, thereby to be changed or modulated in the optical characteristic thereof.

A total body is provided on the glass substrate 31A, and upon the upper surface thereof is provided a glass plate 34 on which the polarization film is mounted. A reference numeral 35A is an insulation film. It is also same to the first embodiment that the switching mode of the liquid crystal is the IPS mode.

However, in the present embodiment, the common electrode 40 is wired by a common electrode wiring 8A. Here, the common electrode wiring 8A and the signal line 4A are in parallel, therefore there can be obtained a layout of no overlap thereof. Then, according to the present invention, the common electrode wiring 8A and the signal line 4A are formed from the same metal wiring layer (metal layer of Al, Cr, etc., for example). On the main level or surface in parallel to the glass substrate 31A, the common electrode wiring 8A and the signal line 4A are formed in a parallel layout, and they are formed in the same step in the processing thereof. Thereby, it is possible to simplify the steps of the process.

On a while, the gate line 3A is formed with a wiring layer being different from those, however the common electrode wiring 8A for transmitting the video signal is lower than that in resistance thereof. With this, it is possible to input signals into the pixels with higher speed.

However, in comparison of the common electrode wiring 8A and the signal line 4A, the common electrode wiring 8A is enlarged in the width thereof, so as to be small in resistance per unit length thereof. This is because, to the common electrode wiring 8A is attached a capacitor being larger than that of the signal line 4A since the pixel capacitors for one (1) line of the pixels is added to it, therefore it is for the purpose of bringing the time constants of the common electrode wiring 8A and the signal line 4A close to each other.

In each of the pixels, the source electrode 32A and the common electrode 40 construct the pixel capacitor 2A therebeteen, however also between the neighboring pixels, there lies a parasitic capacitance between the source electrode 32A and the common electrode 40A. The pixel capacitance 2A is that for driving the liquid crystal corresponding the input signal, however the above-mentioned parasitic capacitance is that of causing malfunction of the liquid crystal, therefore the distance indicated by "DISTANCE 1" in the FIG. 5 must be made large while that indicated by "DISTANCE 2" small. Further, upon the glass plate 34 on which a light shielding layer 41 is mounted, there are provided a color filter 42 and a light shielding layer 41, however this light shielding layer 41 covers the "DISTANCE 2", thereby to protect a visual performance from being influenced by the malfunction of the liquid crystal.

Hereinafter, explanation will be given on a third embodiment, according to the present invention, by referring to FIG. 6.

Figure 6:
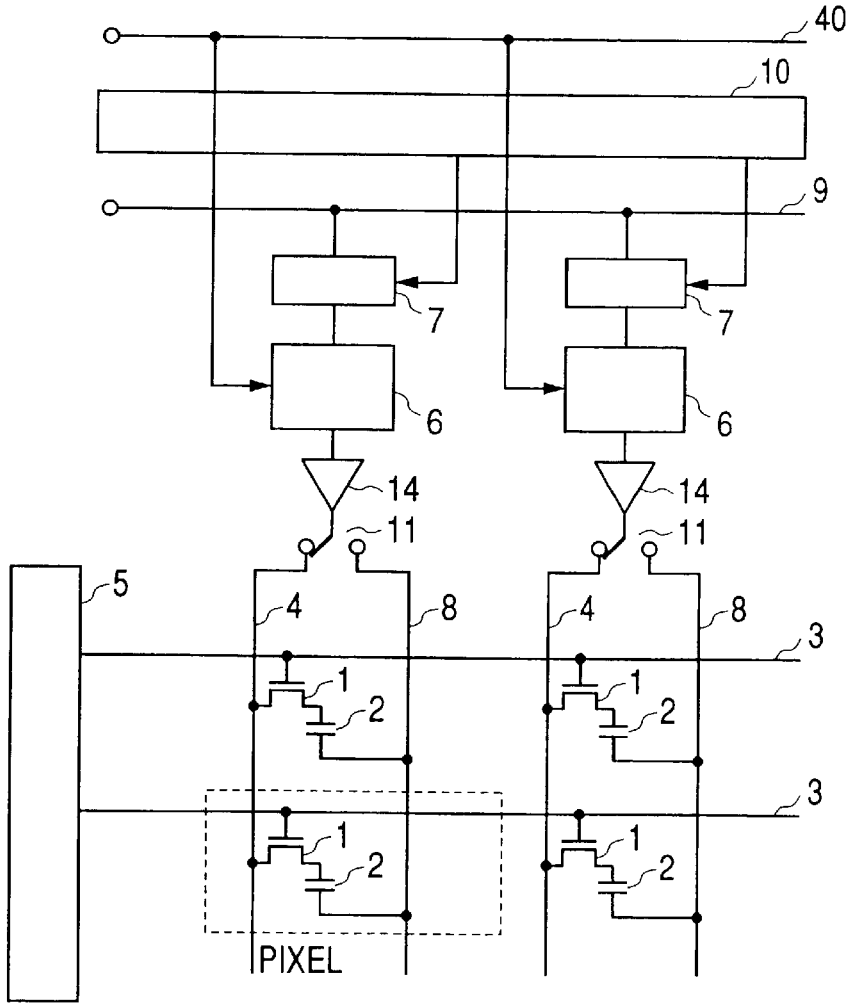
FIG. 6 is a view for showing the structure of a third embodiment of the liquid crystal image display according to the present invention.
Figure 7:
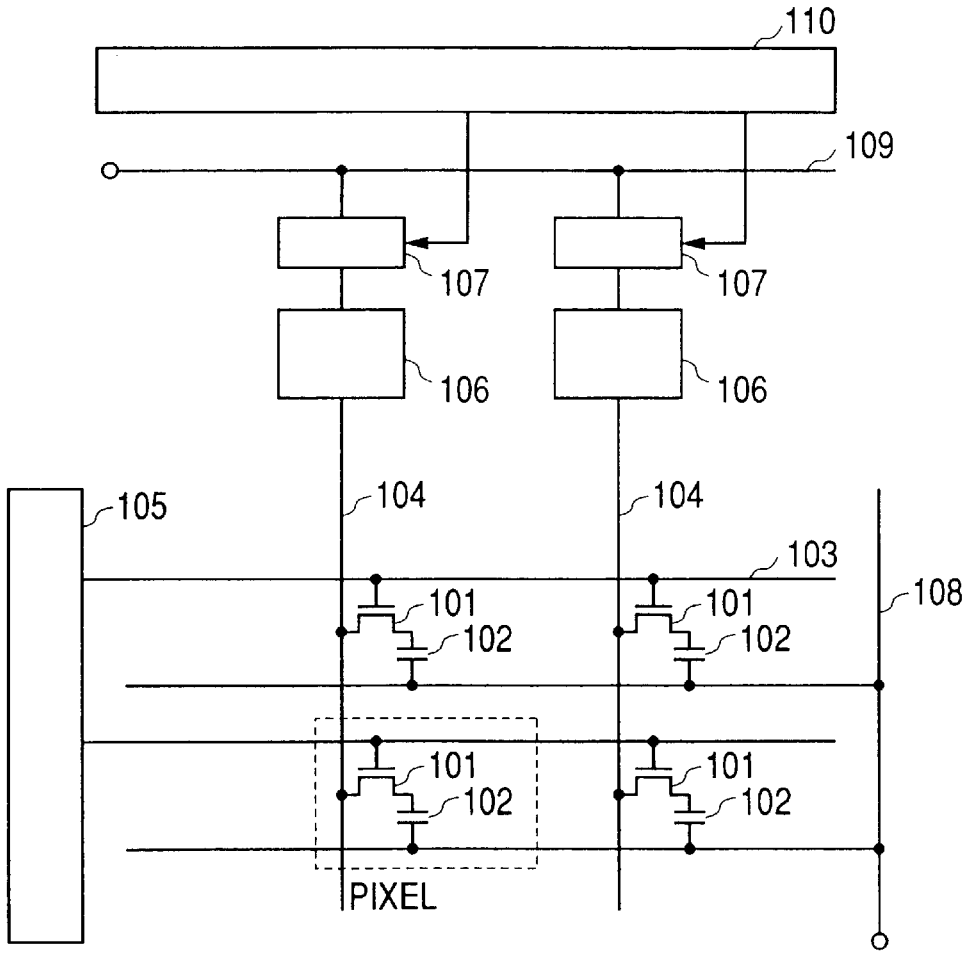
FIG. 7 is a view for indicating the structural example of the conventional video display device.

The FIG. 6 is a view of the structure of other embodiment of the liquid crystal image display, according to the present inanition.

The structure of the present embodiment is same to that of the above-mentioned first embodiment, basically, however it differs from it in aspects that the input of the unity gain amplifier 14 is directly connected to the DA converter 6, and that an input is connected to the DA converter 6 from a reset pulse input line 40.

In the first embodiment, the output of the unity gain amplifier 14 is changed over between the offset output V0 with respect to the reference voltage input and the signal output Vn by turning the input exchange switch 12 and the exchange switch 11 ON and OFF, however in the present embodiment, the output of the unity gain amplifier 14 is changed over between the offset output V0 with respect to the reference voltage input and the signal output Vn by means of the existence of the rest signal to the DA converter 6 through the reset pulse input line 40. Here, when the reset input is entered into, the DA converter 6 outputs an analogue signal of a reference level within a region of the output thereof.

In particular, in the present embodiment, there can be obtained an advantage that not only the unity gain amplifier 14 but also the unevenness or variation of the offset levels in the DA converters 6 can be removed therefrom.

With the embodiments according to the present invention, which are mentioned heretofore, since the fixed pattern noise due to the variation or fluctuation of the threshold voltages in the buffer circuits can be removed therefrom, it is possible to make the area of the DA converters small-sized by using the buffer circuits, without causing the fixed pattern noise therefrom.

Though the explanation was made in detail on the basis of the embodiments of the present invention made by the present inventors, the invention should not be restricted only to those, however it is needless to say that various modification or alternation can be made within a region or breadth, not departing from the gist of the invention.

What is claimed is:

1. A liquid crystal image display, comprising:

a plurality of pixels being disposed in matrix-like form;

a plurality of common electrodes corresponding to the plurality of pixels;

signal lines for plural columns; and gate lines for plural lines, whereby video is displayed on said image display by providing signal voltages through said signal lines for plural columns to pixel electrodes of plural pixels on the lines which are selected by signals on said gate lines, and wherein said signal lines for plural lines are connected to a plurality of buffer circuits, which are provided corresponding to said signal lines, and corresponding to common electrodes, respectively, and said buffer circuits apply voltages to the common electrodes corresponding thereto.

2. A liquid crystal image display, comprising:

signal lines for plural columns;

gate lines for plural lines;

transistors, being disposed on junctures of said signal lines and said gate lines, and each being connected to said signal lines at a drain thereof while connected to said gate line at a gate thereof;

pixel electrodes, each being connected to a source of each of said transistors;

opposite electrodes opposing to said pixel electrodes;

liquid crystal being disposed between said pixel electrodes and said opposite electrodes;

a plurality of wirings, each being provided corresponding to each of said signal lines, and connected to each of said opposite electrodes; and voltage supply circuits, being connected to said signal lines and said wirings, selectively, through switches.

3. A liquid crystal image display, comprising:

a signal line; and a voltage applying circuit for supplying voltage to said signal line, for each line of pixels, wherein an offset voltage, which takes a characteristic value for said voltage applying circuit, is supplied to both the signal line and a common electrode within one (1) line of the pixels.

4. A liquid crystal image display, comprising:

a plurality of pixels being disposed in matrix-like form, each having a semiconductor switch and pixel electrodes for applying an electric field to liquid crystal;

common electrodes being provided for driving said liquid crystal between said pixel electrodes;

pixel selecting means for selecting said pixels in a predetermined order;

signal lines being aligned in a linear direction for inputting signal voltage to the pixel electrodes of said pixels which are selected; and signal voltage applying means provided for each of the signal lines, for applying a signal voltage to said signal lines, wherein corresponding ones of said common electrodes is provided for each of said signal lines, independently; and an output of said signal voltage applying means is connected to both said common electrodes and said signal lines corresponding thereto, through switches.

5. A liquid crystal image display as defined in the claim 4, wherein each of said signal voltage applying means includes a DA converter and a buffer amplifier device having a unity voltage gain.

6. A liquid crystal image display as defined in the claim 5, wherein said buffer amplifier device is constructed by using polycrystalline silicon TFT, to be a differential amplifier, an output of which is connected to a negative input.

7. A liquid crystal image display as defined in the claim 4, wherein each of said signal voltage applying means is constructed by using polycrystalline silicon TFT.

8. A liquid crystal image display as defined in the claim 4, wherein said liquid crystal is driven in an IPS mode.

9. A liquid crystal image display as defined in the claim 4, wherein at least one of said pixel electrode and said common electrode is constructed with a transparent electrode.

10. A liquid crystal image display as defined in the claim 4, wherein an additional capacitance is provide on each said common electrode between a constant electric potential.

11. A liquid crystal image display as defined in the claim 4, wherein said signal voltage applying means applies voltage alternatively to both the common electrode and the signal line corresponding thereto, at a time ratio being nearly equal to each other.

12. A liquid crystal image display as defined in the claim 4, wherein said common electrode and said signal lines are made of a same wiring material.

13. A liquid crystal image display as defined in the claim 4, wherein resistance of wire of said common electrode per a unit of length is lower than that of said signal line.

14. A liquid crystal image display as defined in the claim 4, wherein a distance between electrodes, i.e., between said pixel electrode and said common electrode, within each of the pixels, is larger than that between said pixel electrode and said common electrode, within an inter-pixel area between said pixel and a neighboring one thereof.

15. A liquid crystal image display as defined in the claim 4, wherein a light shielding film is provided on an upper portion between the electrodes, i.e., between said pixel electrode and said common electrode, within said inter-pixel area.

* * * * *